US007169014B2

(12) United States Patent
Taylor et al.

(10) Patent No.: US 7,169,014 B2
(45) Date of Patent: Jan. 30, 2007

(54) APPARATUSES FOR CONTROLLING THE TEMPERATURE OF POLISHING PADS USED IN PLANARIZING MICRO-DEVICE WORKPIECES

(75) Inventors: Theodore M. Taylor, Boise, ID (US); Larry J. Birch, Nampa, ID (US); Freddie L. Dunn, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 476 days.

(21) Appl. No.: 10/198,881

(22) Filed: Jul. 18, 2002

(65) Prior Publication Data

US 2004/0011461 A1 Jan. 22, 2004

(51) Int. Cl.
*B24B 29/02* (2006.01)

(52) U.S. Cl. ..... 451/6; 451/56; 451/285; 451/443; 51/131.4

(58) Field of Classification Search ..... 451/7, 451/21, 41, 56, 285–290, 6, 443; 51/131.4
See application file for complete search history.

(56) References Cited

U.S. PATENT DOCUMENTS 4,450,652 A 5/1984 Walsh
5,127,196 A * 7/1992 Morimoto et al. ..... 451/7
5,196,353 A 3/1993 Sandhu et al.
5,658,183 A * 8/1997 Sandhu et al. ..... 451/5
5,718,620 A * 2/1998 Tanaka et al. ..... 451/288
5,762,537 A 6/1998 Sandhu et al.
5,842,909 A 12/1998 Sandhu et al.
5,893,754 A 4/1999 Robinson et al.
5,957,750 A 9/1999 Brunelli
5,980,363 A 11/1999 Meikle et al.
5,981,396 A 11/1999 Robinson et al.
6,000,997 A 12/1999 Kao et al.
6,187,681 B1 2/2001 Moore
6,284,660 B1 9/2001 Doan
6,312,558 B1 11/2001 Moore
6,375,548 B1 4/2002 Andreas
6,485,359 B1 * 11/2002 Li et al. ..... 451/289
6,544,111 B1 * 4/2003 Kimura et al. ..... 451/288
6,692,338 B1 * 2/2004 Kirchner ..... 451/41

* cited by examiner

*Primary Examiner*—Lee D. Wilson
*Assistant Examiner*—Anthony Ojini
(74) *Attorney, Agent, or Firm*—Perkins Coie LLP

(57) ABSTRACT

Temperature regulation systems and methods for controlling the temperature of polishing pads used in planarizing micro-device workpieces are disclosed herein. In one embodiment, an apparatus for polishing a workpiece includes a platen defining a planarizing zone and a primary duct system. The platen can have a first duct, and the primary duct system can have a second duct operatively coupled to the first duct of the platen. The second duct is configured to direct a gas flow laterally relative to the planarizing zone. The apparatus also includes a pad support carried by the primary duct system, and a polishing pad carried by the pad support. The pad support can have a plurality of apertures that are in fluid communication with the gas flow in the second duct.

55 Claims, 6 Drawing Sheets

APPARATUSES FOR CONTROLLING THE TEMPERATURE OF POLISHING PADS USED IN PLANARIZING MICRO-DEVICE WORKPIECES

TECHNICAL FIELD

The present invention relates to planarizing and polishing micro-device workpieces including mechanical and chemical-mechanical planarization. In particular, the present invention relates to controlling the temperature of the polishing pad during the planarizing cycle.

BACKGROUND

Mechanical and chemical-mechanical planarization processes (collectively "CMP") remove material from the surface of micro-device workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a micro-device workpiece 12 may be attached, or the micro-device workpiece 12 may be attached to a resilient pad 34 under the lower surface 32. The carrier head 30 may be a weighted, free-floating carrier head, or an actuator assembly 36 may be attached to the carrier head 30 to impart rotational motion to the micro-device workpiece 12 (indicated by arrow J) and/or to reciprocate the micro-device workpiece 12 back and forth (indicated by arrow I).

The planarizing pad 40 and a planarizing solution 44 define a planarizing medium that mechanically and/or chemically-mechanically removes material from the surface of the micro-device workpiece 12. The planarizing solution 44 may be a conventional CMP slurry with abrasive particles and chemicals that etch and/or oxidize the surface of the micro-device workpiece 12, or the planarizing solution 44 may be a "clean" non-abrasive planarizing solution without abrasive particles. In most CMP applications, abrasive slurries with abrasive particles are used on non-abrasive polishing pads, and clean non-abrasive solutions without abrasive particles are used on fixed-abrasive polishing pads.

To planarize the micro-device workpiece 12 with the CMP machine 10, the carrier head 30 presses the micro-device workpiece 12 face-downward against the planarizing pad 40. More specifically, the carrier head 30 generally presses the micro-device workpiece 12 against the planarizing solution 44 on a planarizing surface 42 of the planarizing pad 40, and the platen 20 and/or the carrier head 30 moves to rub the micro-device workpiece 12 against the planarizing surface 42. As the micro-device workpiece 12 rubs against the planarizing surface 42, the planarizing medium removes material from the face of the micro-device workpiece 12.

The planarity of the finished micro-device workpiece surface is a function of the distribution of planarizing solution under the micro-device workpiece during planarization, the chemical reaction rate, the relative velocity between the polishing pad and the micro-device workpiece surface, and several other factors. Some of these factors are temperature-dependent, such as the chemical reaction rate.

Accordingly, it can be difficult to achieve a planar micro-device workpiece surface because often the temperature varies across the workpiece surface during planarization. For example, often the relative velocity between the micro-device workpiece surface and the rotating polishing pad is different across the micro-device workpiece surface, consequently creating a temperature gradient. The temperature gradient can generate different chemical reaction rates in the planarizing solution and, accordingly, different polishing rates across the micro-device workpiece that result in a non-planar micro-device workpiece surface.

It is, accordingly, desirable to control the temperature of the planarizing pad to stabilize the temperature-dependent factors that affect the planarity of the micro-device workpiece surface. Previously, attempts have been made to control the temperature by circulating a cooling liquid in the platen. This approach, however, has several disadvantages. It is difficult and expensive to manufacture a liquid system for rotary platens. Liquid systems, for example, require rotary fluid couplings to connect the platen to an external heat exchanger. Liquid systems also require extensive maintenance to prevent leaking and failure of the moving parts. In addition to maintenance expenses, significant downtime may be required to replace or repair rotary couplings or other components. Such significant downtime disrupts production and reduces the throughput of CMP processing.

SUMMARY

The present invention relates to controlling the temperature of a polishing pad during planarizing and/or polishing of micro-device workpieces. In one embodiment, an apparatus for polishing a workpiece includes a platen defining a planarizing zone and a primary duct system. The platen can have a first duct, and the primary duct system can have a second duct operatively coupled to the first duct of the platen. The second duct is configured to direct a gas flow laterally relative to the planarizing zone. The apparatus also includes a pad support carried by the primary duct system, and a polishing pad carried by the pad support. The pad support can have a plurality of apertures that are in fluid communication with the gas flow in the second duct. As a result, the temperature of the gas flow affects the temperature of the polishing pad to control the temperature at the pad/workpiece interface.

In another embodiment, an apparatus for planarizing a micro-device workpiece includes a polishing pad having a planarizing surface for planarizing the micro-device workpiece, a pad support carrying the polishing pad, and a duct system carrying the pad support. The duct system has a duct with at least one inlet and at least one outlet. The duct is configured to direct a gas flow proximate to the pad support in a direction generally parallel to the planarizing surface.

In another embodiment, an apparatus for gas-cooling and/or gas-heating a polishing pad includes a platen having a duct system defined by a plurality of channels configured to receive a gas flow, a pad support carried by the platen, and a polishing pad carried by the pad. The pad support is positioned proximate to the plurality of channels so that the gas flow can cool or heat the pad. The polishing pad has a polishing surface for polishing a micro-device workpiece.

An embodiment of a temperature control system for use with a platen includes a duct system configured for attachment to the platen, and a pad support carried by the duct system. The duct system has at least one inlet, at least one outlet, and at least one duct coupled to the inlet and the outlet. The duct is configured to direct a gas flow under the pad support to control the temperature of the pad.

An embodiment of a method for controlling the temperature of a polishing pad includes causing a gas to flow through a duct system under a polishing pad, and maintaining a desired temperature of the polishing pad with the gas flow. Another embodiment includes flowing gas into a duct system between a polishing pad and a platen, and exhausting the gas from the duct system.

DETAILED DESCRIPTION

The following disclosure is directed to polishing or planarizing machines and methods for controlling the temperature of polishing pads related to mechanical and/or chemical-mechanical planarization of micro-device workpieces. The term "micro-device workpiece" is used throughout to include substrates upon which and/or in which microelectronic devices, micromechanical devices, data storage elements, and other features are fabricated. For example, micro-device workpieces can be semiconductor wafers, glass substrates, insulative substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–10 to provide a thorough understanding of certain embodiments of the invention. One skilled in the art, however, will understand that the present invention may have additional embodiments, or that other embodiments of the invention may be practiced without several of the specific features explained in the following description. For example, even though many of the embodiments are described with reference to cooling a planarizing pad, they can also be used to heat or maintain the temperature of the planarizing pad.

Figure 1:
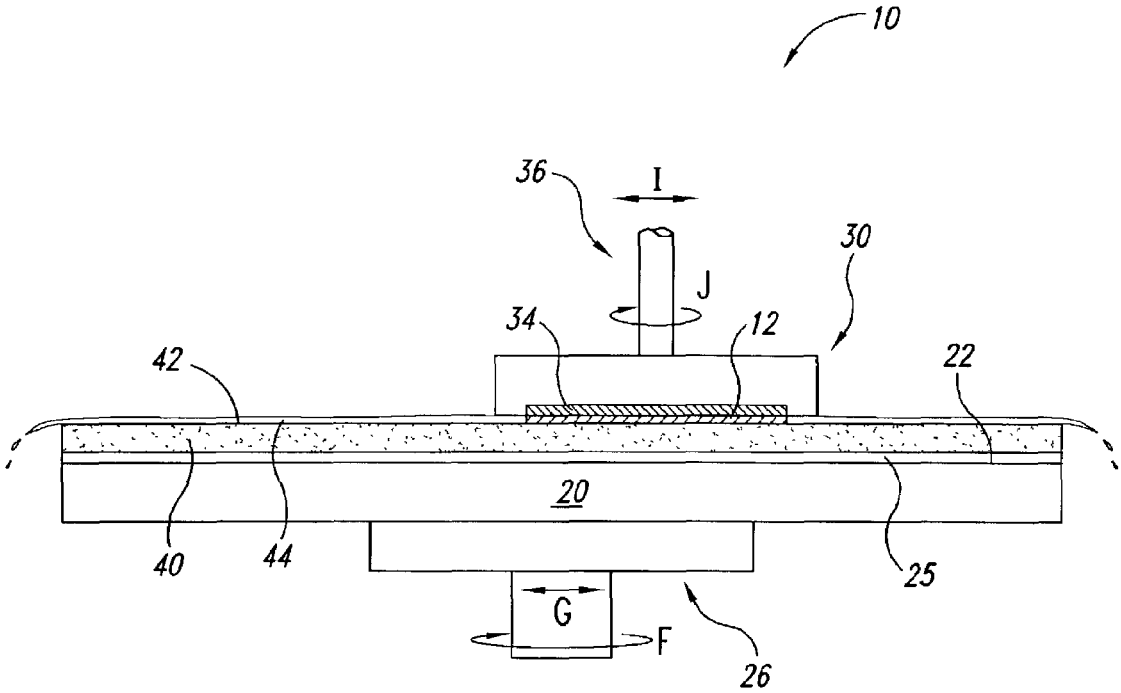
Fig. 1 (Prior Art)
FIG. 1 is a schematic cross-sectional view illustrating a portion of a rotary planarizing machine in accordance with the prior art.
Figure 2:
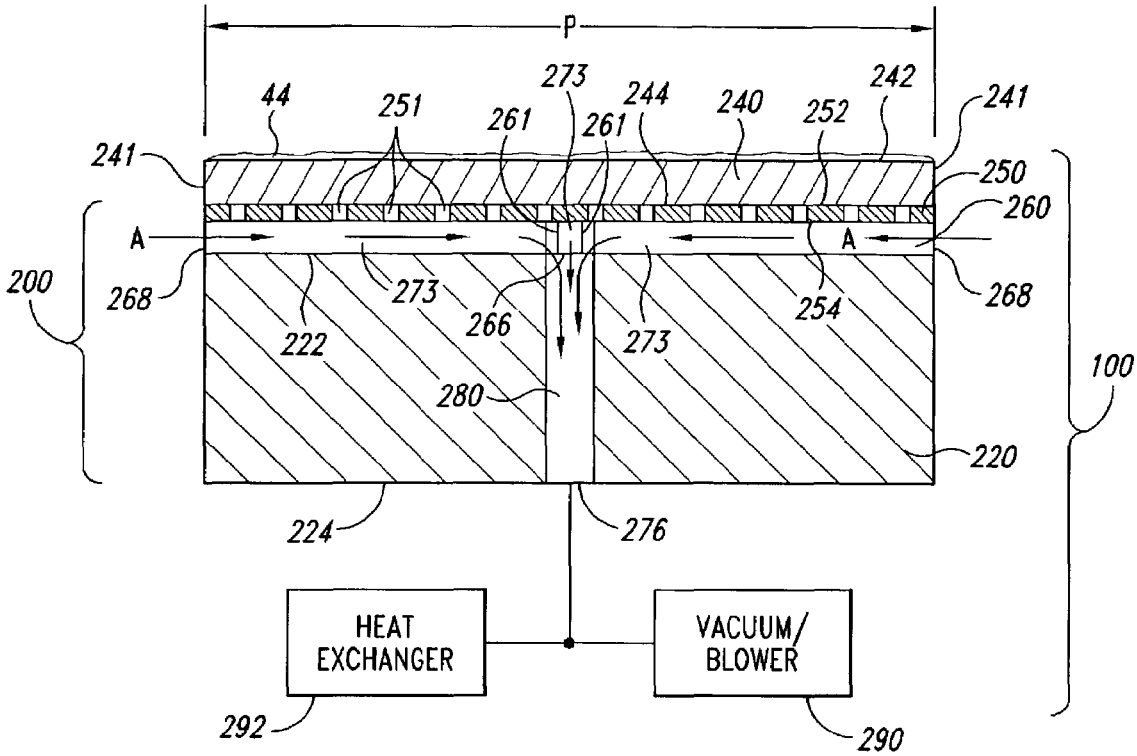
FIG. 2 is a side cross-sectional view of a planarizing pad and a temperature control system in accordance with one embodiment of the invention.

FIG. 2 is a side cross-sectional view of a planarizing machine 100 having a temperature control system 200 in accordance with one embodiment of the invention. The temperature control system 200 of the illustrated embodiment includes a platen 220, a pad support 250, and a duct system 260. The temperature control system 200 assists in regulating the temperature of a planarizing pad 240 to accurately control the polishing rate and other parameters of the planarization process. Temperature control can be advantageous, for example, when a temperature gradient exists across the planarizing pad 240, such as when the temperature of the planarizing pad 240 is greater toward the edge 241. The temperature gradient causes different polishing rates across the workpiece, which, accordingly, result in a non-planar workpiece surface. Moreover, temperature control can be advantageous with some workpieces because the stability of the polishing rate is enhanced when the temperature of the planarizing pad 240 is at or below approximately 70° F.

In the illustrated embodiment, the pad support 250 has an upper surface 252 attached to a backside 244 of the planarizing pad 240, and a lower surface 254 carried by the duct system 260. The pad support 250 can be stiff to provide support to the planarizing pad 240 during the planarizing process. The pad support 250, for example, can be a relatively thin sheet of polymeric material or organic material. In one embodiment, the pad support 250 is composed of FR-4, commonly used as a sub-pad in CMP applications.

The pad support 250 can also include a plurality of apertures 251 to facilitate heat transfer between the planarizing pad 240 and the gas flowing through the duct system 260. Each aperture 251 extends from the lower surface 254 of the pad support 250 to the upper surface 252. In other embodiments, the apertures 251 might not extend completely through the pad support 250, or the pad support 250 might not have apertures. The apertures 251 in the pad support 250 can be arranged in patterns that provide the desired heat transfer rates across the backside 244 of the planarizing pad 240.

Figure 3:
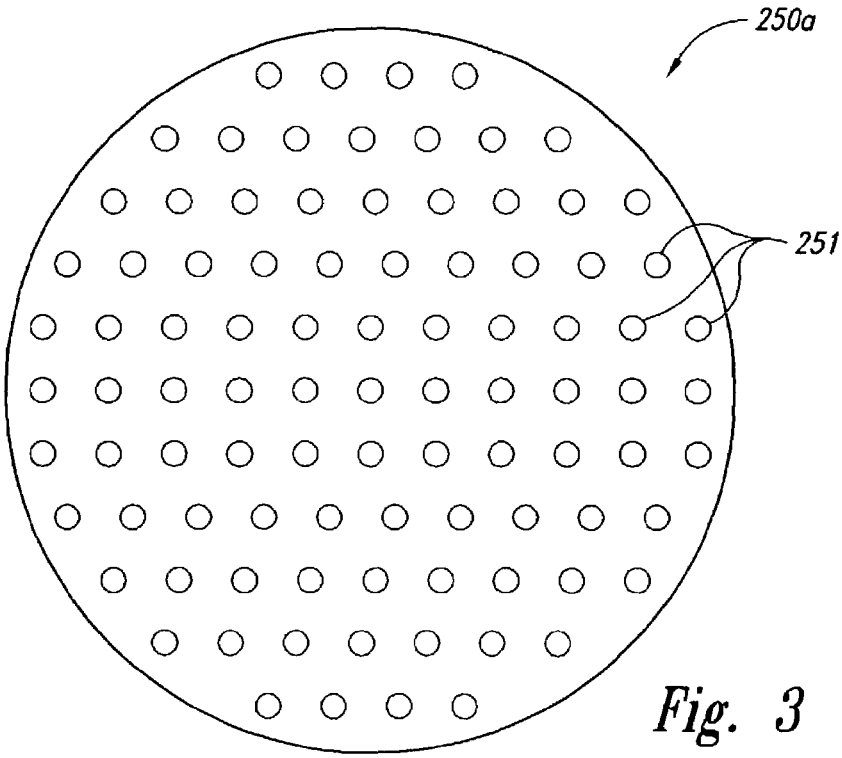
FIG. 3 is a top plan view of the pad support of FIG. 2.
Figure 4:
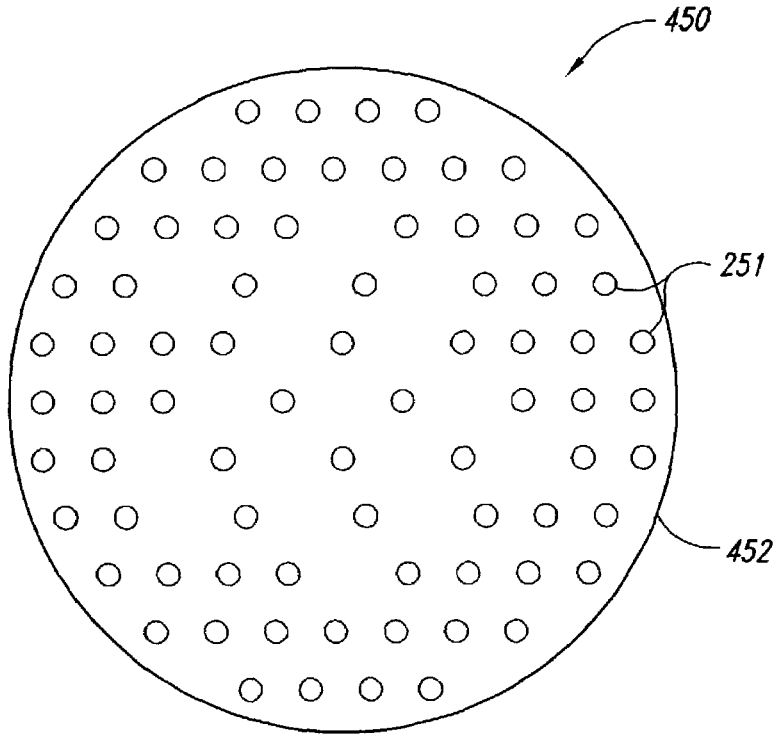
FIG. 4 is a top plan view of a pad support in accordance with another embodiment of the invention.

FIGS. 3 and 4 are top plan views of embodiments of aperture patterns suitable for the pad support 250. FIG. 3, for example, shows a pad support 250*a* with a uniform distribution of apertures 251 to provide a uniform heat transfer distribution across the backside 244 (FIG. 2) of the planarizing pad 240 (FIG. 2). FIG. 4 shows a pad support 450 with a non-uniform arrangement of apertures 251. The pad support 450 has a greater number of apertures 251 in a perimeter region proximate to an edge 452 of the pad support 450 than in a center region. One advantage of the pad support 450 is that the greater concentration of apertures 251 in the perimeter region provides for greater heat transfer between a perimeter region of the planarizing pad 240 (FIG. 2) and the gas in the duct system 260 (FIG. 2). This can be used to provide more heating or cooling at the perimeter of the planarizing pad 240. In other embodiments, other pad supports with different arrangements of apertures can be used to provide different temperature distributions.

Referring to FIG. 2, the platen 220 defines a planarizing zone "P" in which a workpiece is rubbed against the planarizing pad 240. The platen 220 includes a platen duct 280 that extends from an upper surface 222 to a lower surface 224 of the platen 220. In the illustrated embodiment, a vacuum and/or blower 290 is coupled to the platen duct 280 to facilitate the movement of gas through the platen duct 280 and the duct system 260. For example, a vacuum forces gas to flow from the duct system 260, through the platen duct 280, and out through a port 276. Conversely, a blower forces gas in through the port 276, through the platen duct 280, and into the duct system 260. Furthermore, a heat exchanger 292 can be coupled to the platen duct 280 to cool or heat the gas before it enters the platen 220. Other embodiments may not have a heat exchanger, vacuum and/or blower coupled to the duct system 260.

The duct system 260 includes a plurality of ducts 273 that channel the gas to the apertures 251 under the planarizing pad 240. The duct system 260 can also provide a continuous flow of gas under the planarizing pad 240 to maintain a desired heat transfer rate. For example, a gas flow "A" can enter the ducts 273 through openings 268, flow through the ducts 273, and then be exhausted through a central port 266.

Figure 5:
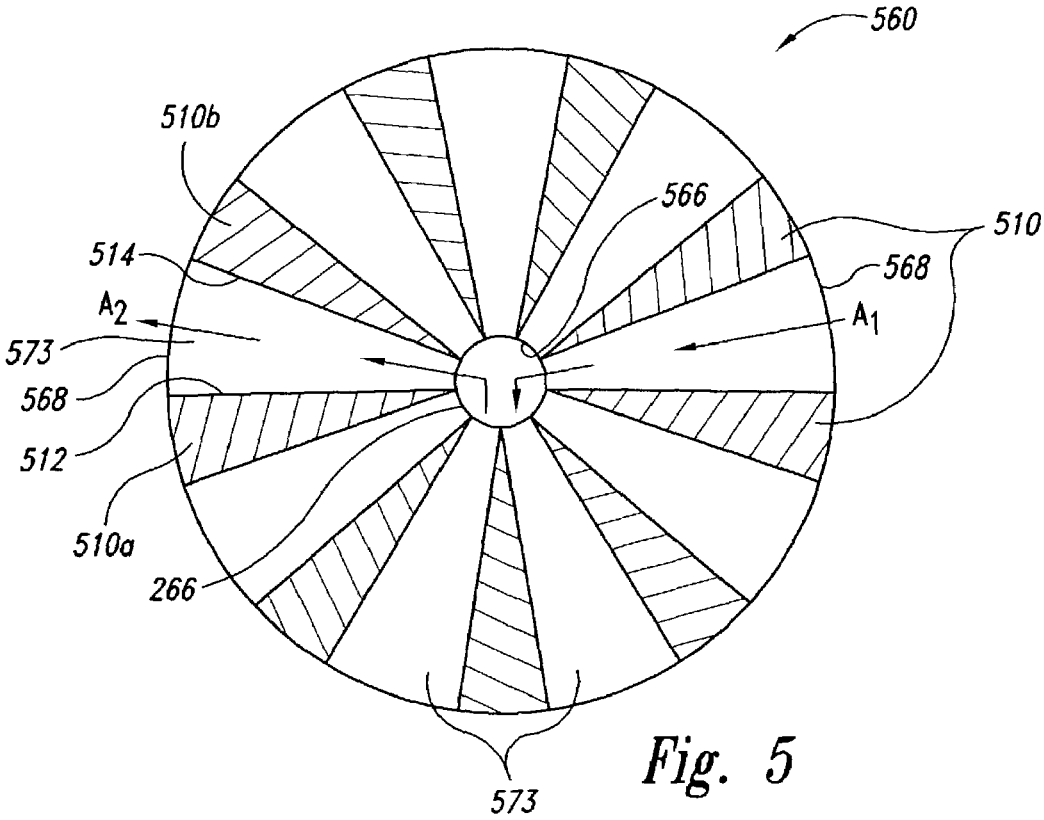
FIG. 5 is a top plan view of the duct system of FIG. 2.

FIG. 5 is a top plan view of one embodiment of a duct system 560. The duct system 560 includes a plurality of raised sections 510 and a plurality of ducts 573 defined by the plurality of raised sections 510. The raised sections 510 carry the pad support 250 (FIG. 2) and can be attached to or an integral part of the platen 220 (FIG. 2). In the illustrated embodiment, each duct 573 is defined by a wall 512 of a first raised section 510*a* and a wall 514 of a second raised section 510*b*. Each duct 573 has an opening 568 at the perimeter, and the duct system 560 has a central port 566. In the operation of one embodiment, gas flows in through the openings 568, along the ducts 573 to pass laterally relative to a planarizing zone, and out through the central port 566 (see arrow $A_1$). Conversely, in another embodiment, gas can flow in through the central port 566 and out through the openings 568 (see arrow $A_2$).

Figure 6:
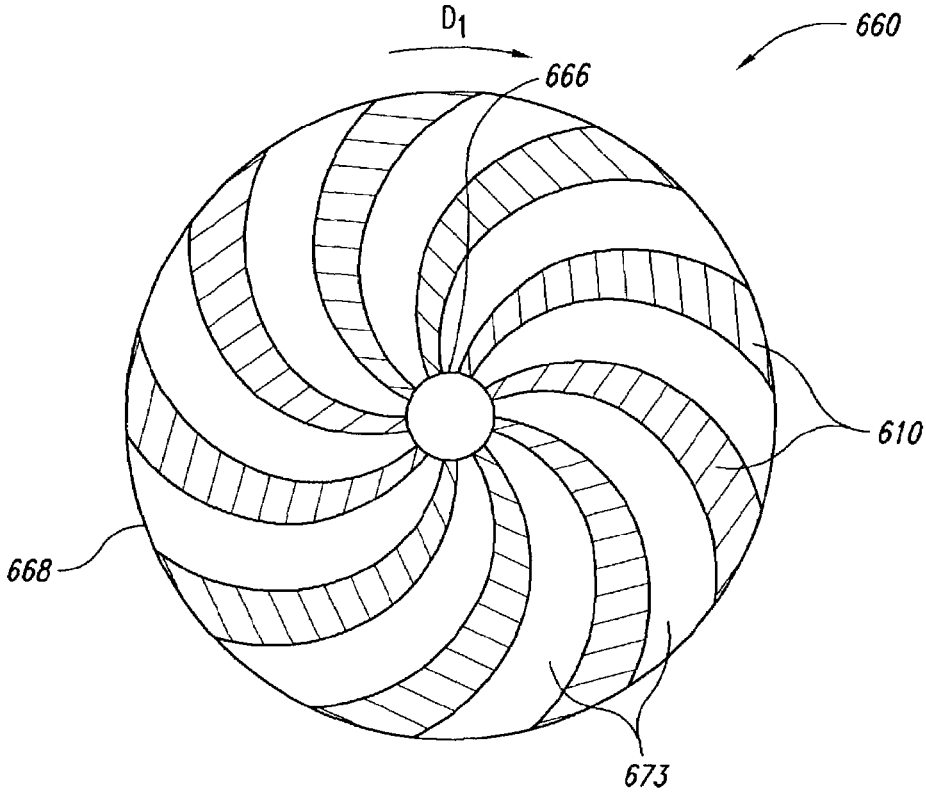
FIG. 6 is a top plan view of a duct system in accordance with another embodiment of the invention.

FIG. 6 is a top plan view of a duct system 660 in accordance with another embodiment of the invention. The duct system 660 of the illustrated embodiment includes a plurality of arcuate raised sections 610 and a plurality of arcuate ducts 673 defined by the raised sections 610. Each duct 673 has an opening 668, and the duct system 660 has a central port 666 similar to the duct system 560 shown in FIG. 5. When the platen 220 (FIG. 2) rotates in a direction $D_1$, the arcuate shape of the ducts 673 drives gas through the openings 668, along the ducts 673 laterally relative to a planarizing zone, and out through the central port 666.

FIGS. 5 and 6 show a number of different duct systems that can be used in the planarizing machine 200 of FIG. 2. It will be appreciated that duct systems for moving or otherwise providing a flow of gas under the planarizing pad can have other configurations in accordance with other embodiments of the invention. For example, the duct system may not have a plurality of ducts, but rather one duct or chamber with a plurality of small supports or posts to support the pad support 250 (FIG. 2). The ducts, therefore, do not need to be defined by walls that extend along a substantial portion of the radius of the platen.

Figure 7:
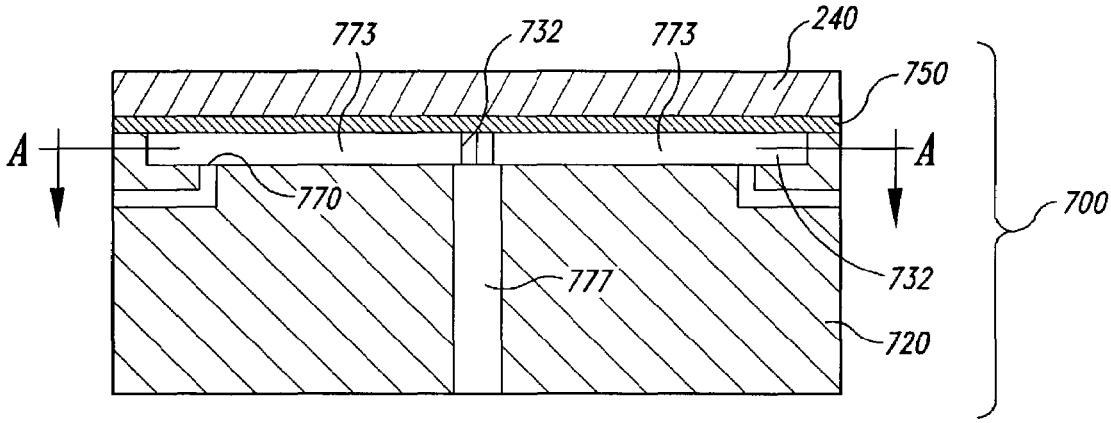
FIG. 7 is a side cross-sectional view of the planarizing pad and a temperature control system in accordance with another embodiment of the invention.

FIG. 7 is a side cross-sectional view of a planarizing machine 700 having a temperature control system in accordance with another embodiment of the invention. The temperature control system of the illustrated embodiment includes a platen 720 having a plurality of channels or ducts 773 between partitions 732, and a pad support 750 carried by the partitions 732. In the illustrated embodiment, the pad support 750 does not have apertures; in additional embodiments, the pad support 750 may have apertures and may be similar to the pad support 250 discussed above.

Figure 8:
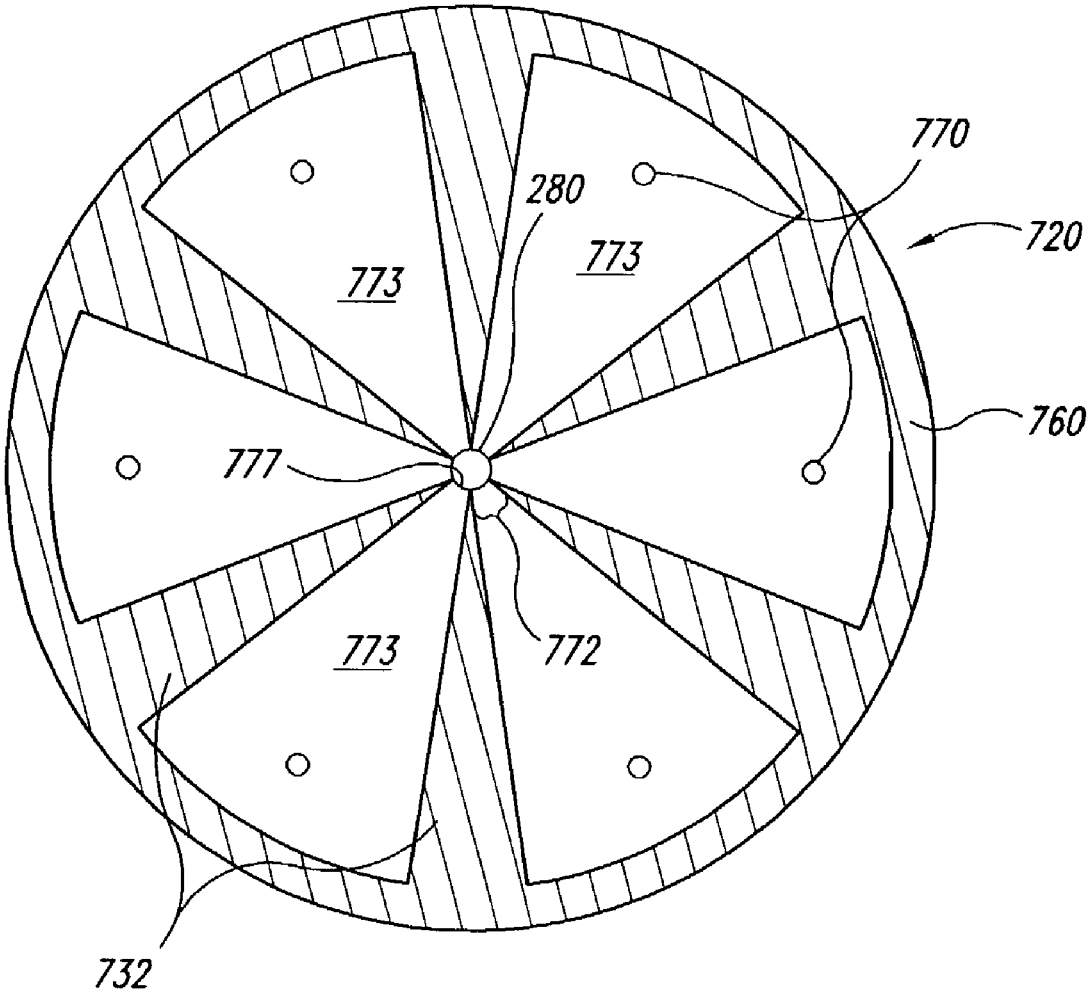
FIG. 8 is a top cross-sectional view of the platen taken substantially along line A—A of FIG. 7.

FIG. 8 is a top cross-sectional view of one embodiment of the platen 720 taken substantially along line A—A of FIG. 7. The ducts 773 are defined by the plurality of partitions 732 and an outer wall 760. The platen 720 also has at least one opening 770 in each of the ducts 773, and a central duct 777. The central duct 777 defines a first duct, and the radial ducts 773 define second ducts. The ducts 773 are spaced apart by a gap 772 between the partitions 732 at the central duct 777. Referring to FIG. 7, in one embodiment, gas can flow in through the openings 770, along the ducts 773, and out through the gaps 772 (FIG. 8). The gas flow can then be exhausted through the central duct 777 in the platen 720. Conversely, in another embodiment, the gas can flow in the opposite direction and be exhausted through the openings 770. Moreover, the platen 720 can be coupled to a blower, vacuum and/or heat exchanger to facilitate the gas flow, as discussed above with reference to FIG. 2. In other embodiments, the plurality of partitions 732 and/or the plurality of ducts 773 can have different shapes or configurations. Furthermore, each duct 773 can have more than one opening 770.

Figure 9:
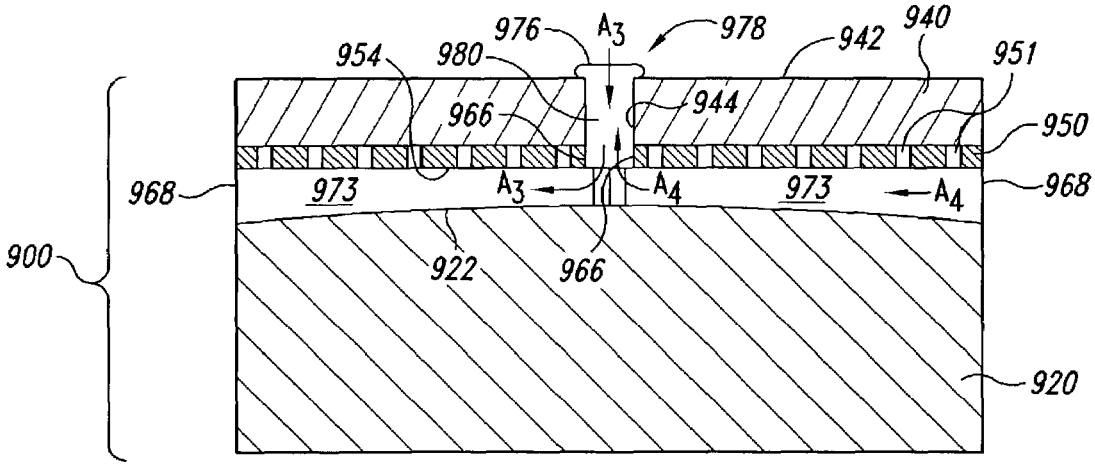
FIG. 9 is a side cross-sectional view of a planarizing pad and a temperature control system in accordance with another embodiment of the invention.

FIG. 9 is a side cross-sectional view of a planarizing machine 900 having a temperature control system in accordance with another embodiment of the invention. The temperature control system of the illustrated embodiment includes a platen 920 having a plurality of ducts 973, and a pad support 950 carried by the platen 920. The plurality of ducts 973 are defined by walls or other types of raised sections similar to those illustrated in FIG. 5 or 6. The ducts 973 also have a base with an inclined upper surface 922. The temperature control system also includes an upper duct 980 coupled to the plurality of ducts 973 to connect the ducts 973 to the ambient air or gas. The upper duct 980 has a lip 978 that extends radially outward to prevent the planarizing solution 44 (FIG. 2) from spilling into the upper duct 980. The pad support 950 has a first aperture 966 that receives the upper duct 980 and a plurality of second apertures 951 arranged in a pattern to provide a desired heat transfer distribution, as explained above. The planarizing machine 900 can also include a planarizing pad 940 having a planarizing surface 942 and a hole 944 through which the upper duct 980 passes. In the illustrated embodiment, if planarizing solution 44 (FIG. 2) spills into the upper duct 980 from the planarizing surface 942, the spilled planarizing solution 44 (FIG. 2) will flow down the inclined upper surface 922 and run off the platen 920. In operation, gas can flow in through a port 976 in the upper duct 980, through the upper duct 980, through the plurality of ducts 973, and out through openings 968 (see arrow $A_3$). Conversely, gas can flow in through the openings 968 and out through the port 976 (see arrow $A_4$).

Figure 10:
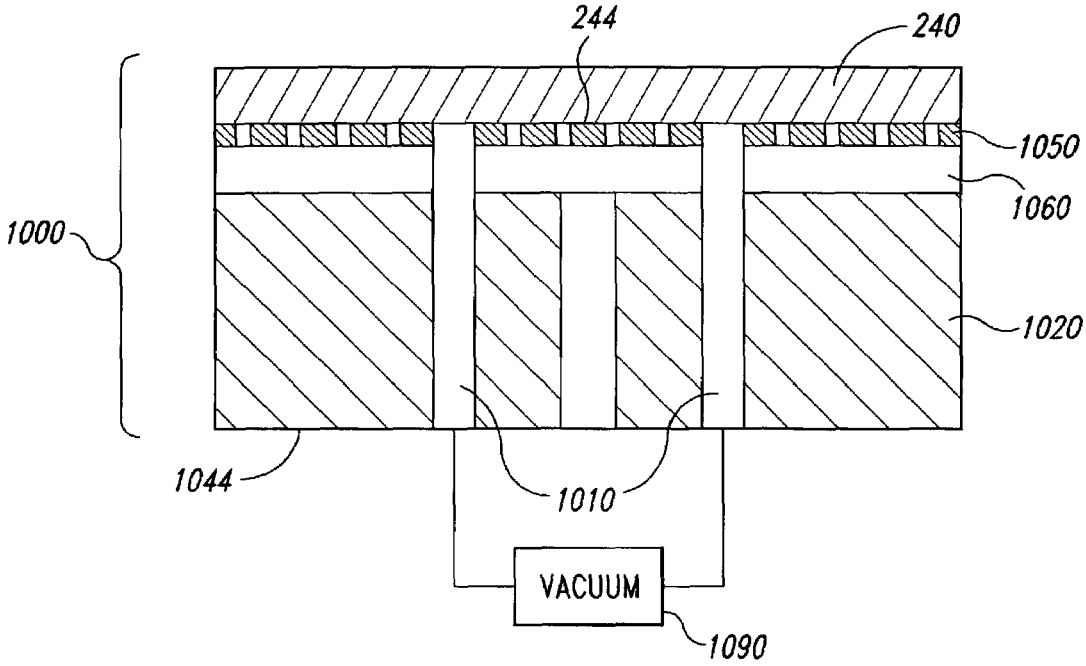
FIG. 10 is a side cross-sectional view of the planarizing pad and a temperature control system in accordance with another embodiment of the invention.

FIG. 10 is a side cross-sectional view of a planarizing machine 1000 having a temperature control system in accordance with another embodiment of the invention. The planarizing pad 240 and the temperature control system of the illustrated embodiment are similar to those shown in FIG. 2. In the illustrated embodiment, however, the planarizing pad 240 is secured to a pad support 1050 by a vacuum 1090. The vacuum 1090 is coupled to four vacuum ducts 1010 (two are shown). The vacuum ducts 1010 extend from the backside 244 of the planarizing pad 240, through the pad support 1050 and a duct system 1060, to a backside 1044 of a platen 1020. The vacuum 1090 creates a subatmospheric pressure to hold the planarizing pad 240 onto the pad support 1050. In other embodiments, the machine may include a different number of vacuum ducts.

An advantage of several of the embodiments discussed above is the ability to control or regulate the temperature of the polishing pad during planarization. Controlling the temperature throughout the polishing pad provides better control of the chemical reaction rate throughout the pad and, consequently, results in control of the planarized surface on the micro-device workpiece. Furthermore, the gas flow temperature control systems are less expensive and easier to maintain than liquid control loops. For example, several embodiments of gas duct systems are less susceptible to downtime for leaks compared to liquid cooling systems because they do not need rotary liquid couplings. Furthermore, air can leak through portions of the platen without creating contamination concerns. Another advantage of many of the embodiments discussed above is that they can be used by retrofitting existing planarizing machines. For example, duct systems can be inserted between polishing pads and platens on existing planarizing machines.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. An apparatus for planarizing a micro-device workpiece, comprising:

a platen defining a planarizing zone, the platen having a first duct;

a primary duct system having a second duct operatively coupled to the first duct, the second duct being configured to direct a gas flow laterally relative to the planarizing zone;

a pad support carried by the primary duct system, the pad support having a plurality of apertures in fluid communication with the gas flow in the second duct; and a polishing pad carried by the pad support.

2. The apparatus of claim 1, further comprising a vacuum or a blower operatively coupled to the first duct to create the gas flow through the primary duct system.

3. The apparatus of claim 1 wherein the apertures are patterned generally uniformly in the pad support.

4. The apparatus of claim 1 wherein the apertures comprise a plurality of first apertures in a first region and a plurality of second apertures in a second region, the first apertures providing a first heat transfer rate per $m^2$ and the second apertures providing a second heat transfer rate per $m^2$ different from the first heat transfer rate.

5. The apparatus of claim 1 wherein a first vacuum duct extends through the platen, the primary duct system, and the pad support, the apparatus further comprising:

a vacuum operatively coupled to the first vacuum duct to hold the polishing pad to the pad support.

6. The apparatus of claim 1, further comprising a heat exchanger coupled to the primary duct system.

7. The apparatus of claim 1 wherein the primary duct system comprises a plurality of radial ducts.

8. The apparatus of claim 1 wherein the primary duct system comprises a plurality of radial ducts, wherein each of the plurality of radial ducts has at least one wall with a curvature configured to drive the gas flow through the plurality of radial ducts when the platen rotates.

9. An apparatus for planarizing a micro-device workpiece, comprising:

a polishing pad including a planarizing surface for planarizing the micro-device workpiece;

a pad support carrying the polishing pad; and a duct system carrying the pad support, the duct system having at least one inlet, at least one outlet, and at least one duct, wherein the duct is configured to direct a gas flow proximate to the pad support in a direction generally parallel to the planarizing surface, and wherein the pad support is at least partially exposed to the gas flow in the duct.

10. The apparatus of claim 9, further comprising a platen having a first duct operatively coupled to the duct system.

11. The apparatus of claim 9, further comprising:

a platen having a first duct operatively coupled to the at least one outlet; and a vacuum operatively coupled to the first duct to create the gas flow through the duct system and the first duct.

12. The apparatus of claim 9, further comprising:

a platen having a first duct operatively coupled to the at least one inlet; and a blower operatively coupled to the first duct to create the gas flow through the duct system and the first duct.

13. The apparatus of claim 9 wherein the pad support comprises a plurality of apertures.

14. The apparatus of claim 9 wherein the pad support comprises a plurality of apertures patterned generally uniformly.

15. The apparatus of claim 9 wherein the pad support comprises a plurality of first apertures in a first region and a plurality of second apertures in a second region, the first apertures providing a first heat transfer rate per $m^2$ and the second apertures providing a second heat transfer rate per $m^2$ different from the first heat transfer rate.

16. The apparatus of claim 9 wherein the pad support and the polishing pad have a first duct extending generally transversely through the pad support and the polishing pad, and the first duct is operatively coupled to the duct system.

17. The apparatus of claim 9 wherein the pad support and the polishing pad have a first duct extending generally transversely through the pad support and the polishing pad, and the first duct is operatively coupled to the duct system and includes a lip proximate to the planarizing surface of the polishing pad to prevent planarizing solution from spilling into the first duct.

18. The apparatus of claim 9 wherein a first vacuum duct extends through the duct system and the pad support, the apparatus further comprising:

a vacuum operatively coupled to the first vacuum duct to secure the polishing pad to the pad support.

19. The apparatus of claim 9, further comprising a heat exchanger coupled to the duct system.

20. The apparatus of claim 9 wherein the duct system comprises a plurality of radial ducts.

21. The apparatus of claim 9 wherein the duct system comprises a plurality of radial ducts, wherein each of the plurality of radial ducts has at least one wall with a curvature configured to drive the gas flow through the plurality of radial ducts when the duct system rotates.

22. An apparatus for gas-cooling and/or gas-heating a polishing pad, comprising:

a platen having a plurality of channels configured to receive a gas flow;

a pad support carried by the platen proximate to the plurality of channels so that the pad support is exposed to the gas flow and the gas flow can at least one of cool or heat the pad support; and a polishing pad carried by the pad support, the polishing pad having a polishing surface for polishing a micro-device workpiece.

23. The apparatus of claim 22 wherein the platen comprises a first duct operatively coupled to the plurality of channels.

24. The apparatus of claim 22 wherein the platen comprises a first duct operatively coupled to the plurality of channels, the apparatus further comprising:

at least one of a vacuum or a blower operatively coupled to the first duct to create the gas flow through the plurality of channels and the first duct.

25. The apparatus of claim 22 wherein the pad support comprises a plurality of apertures.

26. The apparatus of claim 22 wherein the pad support and the polishing pad have a first duct extending generally transversely through the pad support and the polishing pad, the first duct operatively coupled to the plurality of channels.

27. The apparatus of claim 22 wherein the pad support and the polishing pad have a first duct extending generally transversely through the pad support and the polishing pad, and the first duct is operatively coupled to the plurality of channels and includes a lip proximate to the polishing surface of the polishing pad to prevent planarizing solution from spilling into the first duct.

28. The apparatus of claim 22, further comprising:

a first vacuum duct extending through the pad support and the platen; and a vacuum operatively coupled to the first vacuum duct to secure the polishing pad to the pad support.

29. The apparatus of claim 22, further comprising a heat exchanger in fluid communication with the plurality of channels.

30. The apparatus of claim 22 wherein each of the plurality of channels has at least one wall with a curvature configured to drive the gas flow through the plurality of channels when the platen rotates.

31. A planarizing machine for mechanical or chemical-mechanical planarization of micro-device workpieces, comprising:

a platen having a first duct;

a primary duct system operatively coupled to the first duct, the duct system being configured to direct a gas flow;

a pad support carried by the primary duct system and at least partially exposed to the gas flow;

a polishing pad carried by the pad support; and a carrier assembly having a drive system and a carrier head coupled to the drive system, the carrier head being configured to hold a micro-device workpiece and the drive system being configured to move the carrier head to engage the micro-device workpiece with the polishing pad, wherein the carrier head and/or the platen is movable relative to the other to rub the micro-device workpiece against the polishing pad.

32. The planarizing machine of claim 31, further comprising a vacuum or a blower operatively coupled to the first duct to create the gas flow through the primary duct system and the first duct.

33. The planarizing machine of claim 31 wherein the pad support comprises a plurality of apertures.

34. The planarizing machine of claim 31, further comprising a heat exchanger coupled to the primary duct system.

35. A planarizing machine for mechanical or chemical-mechanical planarization of micro-device workpieces, comprising:

a platen defining a planarizing zone, the platen having a first duct;

a primary duct system having a second duct operatively coupled to the first duct, the second duct being configured to direct a gas flow laterally relative to the planarizing zone;

a pad support carried by the primary duct system, the pad support having a plurality of apertures in fluid communication with the gas flow in the second duct;

a polishing pad carried by the pad support; and a carrier assembly having a drive system and a carrier head coupled to the drive system, the carrier head being configured to hold a micro-device workpiece and the drive system being configured to move the carrier head to engage the micro-device workpiece with the polishing pad, wherein the carrier head and/or the platen is movable relative to the other to rub the micro-device workpiece against the polishing pad.

36. The planarizing machine of claim 35, further comprising a vacuum or a blower operatively coupled to the first duct to create the gas flow through the primary duct system and the first duct.

37. The planarizing machine of claim 35, further comprising a heat exchanger coupled to the primary duct system.

38. A planarizing machine for mechanical or chemical-mechanical planarization of micro-device workpieces, comprising:

a platen having a plurality of channels for receiving a gas flow;

a pad support attachable to the platen proximate to the plurality of channels so that the pad support is exposed to the gas flow and the gas flow can cool or heat the pad support;

a polishing pad carried by the pad support, the polishing pad having a polishing surface for polishing a micro-device workpiece; and a carrier assembly having a drive system and a carrier head coupled to the drive system, the carrier head being configured to hold a micro-device workpiece and the drive system being configured to move the carrier head to engage the micro-device workpiece with the polishing pad, wherein the carrier head and/or the platen is movable relative to the other to rub the micro-device workpiece against the polishing pad.

39. The planarizing machine of claim 38, further comprising a vacuum or a blower operatively coupled to the platen to create the gas flow through the plurality of channels.

40. The planarizing machine of claim 38 wherein the pad support comprises a plurality of apertures.

41. The planarizing machine of claim 38, further comprising a heat exchanger coupled to the plurality of channels.

42. A temperature control system for use with a platen, comprising:

a duct system configured for attachment to the platen, the duct system having at least one inlet, at least one outlet, and at least one duct configured to direct a gas flow; and a pad support carried by the duct system and at least partially exposed to the gas flow, wherein the gas flow can move through the duct system to control the temperature of the pad support.

43. The system of claim 42 wherein the pad support comprises a plurality of apertures.

44. The system of claim 42 wherein the pad support comprises a plurality of apertures patterned generally uniformly.

45. The system of claim 42 wherein the pad support comprises a plurality of first apertures in a first region and a plurality of second apertures in a second region, the first apertures providing a first heat transfer rate per $m^2$ and the second apertures providing a second heat transfer rate per $m^2$ different from the first heat transfer rate.

46. The system of claim 42 wherein the duct system comprises a plurality of radial ducts.

47. The system of claim 42 wherein the duct system comprises a plurality of radial ducts, wherein each of the plurality of radial ducts has at least one wall with a curvature configured to drive the gas flow through the plurality of radial ducts when the duct system rotates.

48. An apparatus for controlling the temperature of a polishing pad, comprising:

a polishing pad defining a planarizing zone;

a pad support carrying the polishing pad, the pad support having a plurality of apertures; and a duct system carrying the pad support, the duct system having at least one duct configured to direct a gas flow laterally relative to the planarizing zone, wherein the plurality of apertures is in fluid communication with the at least one duct.

49. The apparatus of claim 48 wherein the plurality of apertures is patterned generally uniformly.

50. The apparatus of claim 48 wherein the plurality of apertures comprise a plurality of first apertures in a first region and a plurality of second apertures in a second region, the first apertures providing a first heat transfer rate per $m^2$ and the second apertures providing a second heat transfer rate per $m^2$ different from the first heat transfer rate.

51. The apparatus of claim 48 wherein the duct system comprises a plurality of radial ducts.

52. The apparatus of claim 48 wherein the duct system comprises a plurality of radial ducts, wherein each of the plurality of radial ducts has at least one wall with a curvature configured to drive the gas flow through the plurality of radial ducts when the duct system rotates.

53. A planarizing machine for mechanical or chemical-mechanical planarization of micro-device workpieces, comprising:

a polishing pad defining a planarizing zone;

a pad support carrying the polishing pad, the pad support having a plurality of apertures;

a duct system carrying the pad support, the duct system having at least one duct configured to direct a gas flow laterally relative to the planarizing zone, wherein the plurality of apertures is in fluid communication with the at least one duct; and a carrier assembly having a drive system and a carrier head coupled to the drive system, the carrier head being configured to hold a micro-device workpiece and the drive system being configured to move the carrier head to engage the micro-device workpiece with the polishing pad, wherein the carrier head and/or the platen is movable relative to the other to rub the micro-device workpiece against the polishing pad.

54. The planarizing machine of claim 53, further comprising a vacuum or a blower operatively coupled to the duct system to create the gas flow through the duct system.

55. The planarizing machine of claim 53, further comprising a heat exchanger coupled to the duct system.

* * * * *